United States Patent [19]

Braswell

[11] Patent Number: 4,986,771

[45] Date of Patent: Jan. 22, 1991

[54] CLAMPING DEVICE

[75] Inventor: Richard R. Braswell, Long Beach, Calif.

[73] Assignee: The Richards-Braswell Research Corporation, Signal Hill, Calif.

[21] Appl. No.: 121,279

[22] Filed: Oct. 13, 1989

[51] Int. Cl.[5] ..... H01R 4/38; H01R 4/36; H01R 11/03

[52] U.S. Cl. ..... 439/790; 439/805; 439/812

[58] Field of Search ..... 439/790–792, 439/765, 769, 801, 805, 812

[56] References Cited

U.S. PATENT DOCUMENTS

| | | | |
|---|---|---|---|
| 175,567 | 4/1875 | Krause | 269/226 |
| 225,000 | 3/1880 | Dickson | 269/226 |
| 516,853 | 3/1894 | Turner | 310/233 |
| 906,385 | 12/1908 | Christians | 269/226 |
| 1,383,406 | 12/1921 | Jung | 238/59 |
| 1,500,499 | 7/1924 | Johnson, Jr. | 439/806 |
| 1,594,925 | 8/1926 | Chandler | 337/193 |
| 1,737,506 | 11/1929 | McCracken | 439/806 |
| 1,809,774 | 6/1931 | Coates | 439/806 |
| 2,159,154 | 5/1939 | Hixon | 173/273 |
| 2,573,972 | 11/1951 | Holland | 173/259 |
| 2,576,420 | 11/1951 | Simonsen | 269/226 |
| 2,613,243 | 10/1952 | Frear | 173/273 |
| 3,209,307 | 9/1965 | Hoffman | 339/109 |
| 4,294,505 | 10/1981 | Gaffney | 439/769 |
| 4,457,577 | 7/1984 | Browne et al. | 339/14 L |
| 4,500,081 | 2/1985 | Carossino | 269/93 |
| 4,695,118 | 9/1987 | Magdesyan et al. | 439/756 |
| 4,758,188 | 7/1988 | Yates | 439/759 |

*Primary Examiner*—Paula A. Bradley

*Attorney, Agent, or Firm*—Fulwider, Patton, Lee & Utecht

[57] ABSTRACT

An apparatus for securely clamping items having various shapes and sizes for placing items into direct electrical contact, the apparatus including a reference member, a receiving cavity therein and having a pair of mounting flanges extending outward therefrom. A worm gear member, rotatably mounted on the reference member is meshed with a pivoting member, having a gear portion, a contoured engaging surface and a hooking tab. Rotation of the worm gear member selectively pivots the pivoting member away from the reference member.

10 Claims, 2 Drawing Sheets

CLAMPING DEVICE

BACKGROUND OF THE INVENTION

1. Field of Invention

The present invention relates generally to improvements in clamping devices and, more particularly, to a new and improved device for securely clamping items having various shapes and sizes and for placing the items in direct contact with each other.

2. Description of the Prior Art

It is often desirable to selectively clasp, brace or fasten items together. For this reason, a multitude of clamps or fasteners have been created, some of which are spring loaded to urge the generally oppositely facing engaging surfaces towards one another to grasp an item therebetween. In other forms, screw or other biasing elements may be used to bring the engaging surfaces together.

One common application of clamping devices is for the quick and easy removal of electrical wiring to various electrical terminals. In this application, the clamping device acts as an electrical connector which can be affixed to each end of the wiring to connect the items, usually a power source and the powered item together. The connector is designed to grasp and retain the electrical terminal which is usually formed as extending posts or tabs on the powered item. In this arrangement, the clamp-like connector can be easily removed or placed on the terminal, eliminating the need for a soldered joint or other similar connector.

An alligator clip is one example of a clamping device that can be used as an electrical connector. The clip generally includes a pair of opposing jaw members that are pivotally mounted to each other, each jaw having opposing serrated surfaces. A helical spring provides a biasing force that urges the jaws towards one another and maintains the jaws in contact with the item that is placed therebetween.

One problem associated with the alligator clip connector is its inability to securely engage larger sized or odd shaped terminals. Generally, as the engaging jaws of alligator clips are further separated, the helical spring is displaced further from its rest position, increasing the bias between the jaws. However, as the jaws are opened more and more, the engaging surfaces are increasingly angled relative to each other. This increased angle, in combination with the increased biasing force, makes it more difficult for the alligator clips to securely engage the larger shaped terminals. This is best illustrated in the difficulty which arises when an alligator-type clip is attached to an automobile battery terminal.

Another problem may arise if the connector is used with testing or measuring instrumentation. For example, ohm or volt meters have positive and negative leads which terminate at an electrically sensitive probe that should be in direct contact with the item being tested, e.g., a battery or a piece of wire. If an alligator clip or other type of clasping connector is connected to the probe, without having the probe in direct contact with the test item, the readings of the testing instrument may be impaired. Thus, the testing instrument may provide a more accurate reading if the probes are directly connected to the test material.

Still another problem that may arise from the use of electrically conductive electrical connectors is the possibility that the user may receive an electrical shock if he or she inadvertently touches an exposed surface of a "hot" connector. Responsive to this problem, non-conductive covers have been formed around the connector to provide an insulating layer to protect its user. However, these covers eventually fray and crack with age, reducing their effectiveness.

Hence, those concerned with the development and use of electrical connectors have long recognized the need for a connector for directly connecting a lead to the item being tested along with the need for an improved connector that can be clamped to terminals of varying shapes and sizes. The present invention clearly fulfills all of these needs.

SUMMARY OF THE INVENTION

Briefly, and in general terms, the present invention provides a new and improved apparatus for clamping variously shaped objects together.

Basically, the present invention is directed to an improved clamping device which provides a contoured engaging surface and hooking tab for securely engaging variously shaped objects. Further, the improved clamp enables a terminal to be held in direct contact with a probe for testing purposes.

In one preferred embodiment of the present invention, a reference member having a base with a longitudinal axis, a first end, and a second end, has an arm extending outward from the first end. A receiving aperture is formed within the distal end of the arm to snuggly receive the probe or terminal lead. A pair of generally parallel mounting flanges extends outward from the second end of the base, substantially orthogonal relative to the arm. Each flange has an aligned receiving aperture formed therein. A receiving cavity or trough is defined in the second end of the reference member and between the flanges. A worm member is rotatably mounted on the reference member.

A pivoting engaging member is pivotally mounted between the mounting flanges by the receipt of oppositely extending pivot pins within the receiving apertures. Gear teeth formed on a portion of the pivoting member mesh with the worm member so that axial rotation of the worm member selectively pivots the distal end of the pivoting member relative to the reference member. A hooking tab extends towards the reference member from the distal end of the pivoting member and is angled inward toward the gear portion. A contoured engaging surface having arcuate surfaces with different arc radii and centers extends generally between the hooking tab and the gear portion.

From the above description, it can be readily seen that the present invention presents a new and useful apparatus for engaging variously shaped objects and enabling a terminal to be placed in direct contact with a probe for testing purposes.

These and other objects and advantages of the invention will become apparent from the following detailed description, taken in conjunction with the accompanying drawings, which illustrate, by way of example, the principles of the invention.

DETAILED DESCRIPTION OF THE INVENTION

As shown in the exemplary drawings, an improved clamping device shown as an electrical connector and constructed in accordance with the present invention is provided for directly abutting a terminal lead to a variety of posts or terminals.

Figure 1:
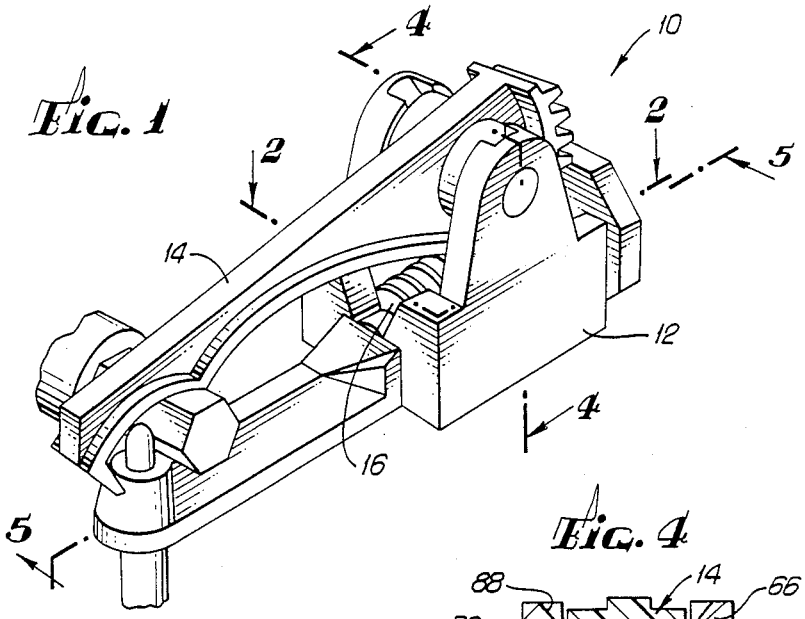
FIG. 1 is an enlarged perspective view of a clamp embodying the novel features of the present invention in combination with a first and second terminal lead.

As best shown in FIG. 1, the connector 10 embodying the features of the present invention includes a first or reference member 12 pivotally mounted to a second or pivoting member 14. Axial rotation of the worm member 16 disposed between the pivoting member 14 and the reference member 12, rotatably mounted upon the first member or reference and threadingly engaged with the second or pivoting member, selectively pivots the second member relative to the first member.

Figure 2:
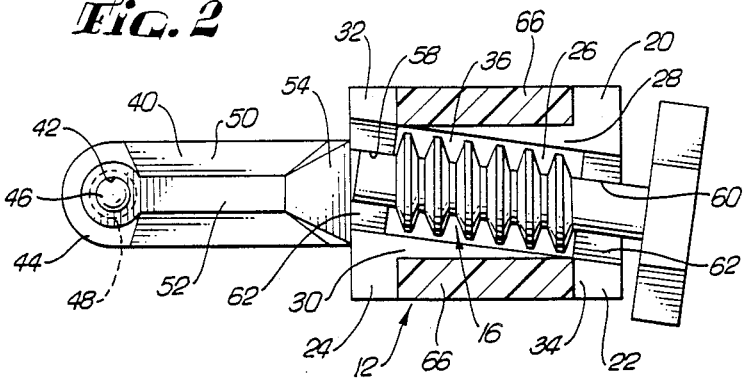
FIG. 2 is a top elevational sectional view of the present invention, taken substantially along the lines 2—2 of FIG. 1.

As best shown in FIG. 2, the reference member 12 has a base portion 20 with a first end 22, a second end 24, and a generally longitudinal axis extending therebetween. In the preferred embodiment, the base portion 20 includes a bottom wall 26 and side walls 28 and 30 extending upward therefrom. End walls 32 and 34 extend upward and are joined along their respective edges to the side walls 28 and 30 to define a receiving cavity or trough 36.

Still referring to FIG. 2, a first or reference arm 40 extends outward from the second end 24 of the base portion 20. The first arm 40 extends outward from the base portion 20 generally along the longitudinal axis thereof. A receiving aperture or bore 42 is formed at the first or distal end 44 of the arm 40, generally orthogonal to the longitudinal axis of the arm. In one embodiment, the receiving bore 42 is sized to snuggly receive the lead terminal 46 of an ohm meter. The diameter of the bore 42 may vary depending upon the diameter of the lead terminal 46 being received therethrough. For example, a bore diameter of about 0.05 to 0.10 inches, most preferably, about 0.07 inches may be used. To facilitate the insertion of the lead terminal 46 into the receiving bore 42, a concentric counter bore 48 having a larger diameter than that of the receiving bore, e.g., about 0.1 inches, extends outward from the receiving bore 42 about 0.05 inches. By this construction, the inserted lead terminal 46 is snuggly engaged as it extends through and outward from the first arm 40. To minimize the cross-sectional silhouette, the arm 40 may have a ridge portion 50 which is angled laterally inward towards an apex 52. Reinforcing gussets 54 may be formed along the junction of the reference arm 40 to the base 20.

Figure 3:
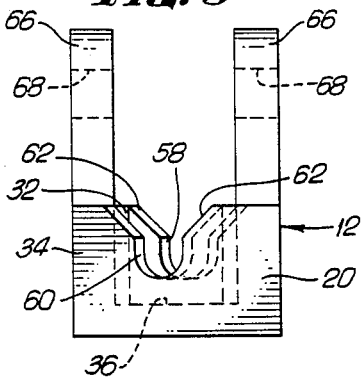
FIG. 3 is a rear elevational view of the reference arm of the present invention.

As best shown in FIG. 3, generally U-shaped slots 58 and 60 formed within end walls 32 and 34, respectively, of the reference member 12 are sized to slidably receive the worm member 16 as described more fully elsewhere in the application. Each slot 58 or 60 may be formed to include a V-shaped upper portion 62 to aid in the insertion of the worm member 16 into the slots. Generally, these slots 58 and 60 are aligned along a common slot axis extending generally from the base portion first end 22 to its second end 24. By this construction, the worm member 16 is positioned generally longitudinally or parallel to the longitudinal axis of the reference member 12. In one embodiment, the axis defined by the slots 58 and 60 may be shifted off the central longitudinal axis of the base 20 but remain in the same general horizontal plane, by rotation of the slot axis about a substantially vertical axis. The amount of lateral rotation may depend on the lead or helix angle of the worm member 16 to enable meshing of the worm member 16 with a straight cut gear portion as described more fully elsewhere in this application. For example, in one particular embodiment, the slot axis may be shifted about the substantially vertical axis about seven degrees relative the central longitudinal axis.

Still referring to FIG. 3, extending outward from the side walls 28 and 30 are mounting flanges 66. In the preferred embodiment, the mounting flanges 66 are formed to extend upward from and substantially parallel with the side walls 28 and 30. A pivot pin receiving bore or aperture 68 is formed within each mounting flange 66. Each pivot pin receiving aperture 68 is generally aligned with each other along an axis generally perpendicular to the longitudinal axis of the base 20.

Figure 4:
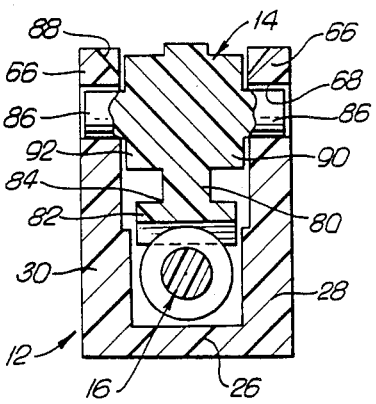
FIG. 4 is a fragmentary rear elevational, sectional view of the present invention, substantially taken along the lines 4—4 of FIG. 1.

As best shown in FIG. 4, the pivoting member 14 is pivotally mounted to the reference member 12 and in threaded engagement with the worm member 16 disposed therebetween. The pivot pin apertures 68 are positioned, e.g., about one quarter of an inch from the apex of the side wall 28, so that the pivoting member 14 and the worm member 16 are in threaded or meshed engagement with each other. Pivoting member 14 has a central planar panel 80 having an engaging lip 82 extending along a first or lower edge 84 of the planar panel to form a generally T-shaped vertical cross-section. Pivot pins 86 extend laterally outward generally orthogonal to the plane of the planar panel 80 for receipt within pivot pin apertures 68 formed within mounting flanges 66. Beveled slots 88 may be formed within the top portion of the mounting flanges 66 to facilitate the insertion of the pivot pins 86 into the receiving aperture 68.

Still referring to FIG. 4, hub portions 90 are concentrically formed about the pivot pins 86 and extend laterally outward from opposite faces of the central planar panel 80. Each hub portion 90 extends outward from the central panel 80 a sufficient distance to slidably engage with the interior surfaces 92 of the mounting flanges 66. For example, in a preferred embodiment, the hub portions 90 may extend outward a distance of about 0.135 inches from the central axis of the central panel 80 and the pivot pin 86 may extend outward about 0.21 inches from the center of the planar panel 80. The hub portion may have an outside diameter of about 0.250 inches while the pivot pins may have an outside diameter of about 0.11 inches.

Figure 5:
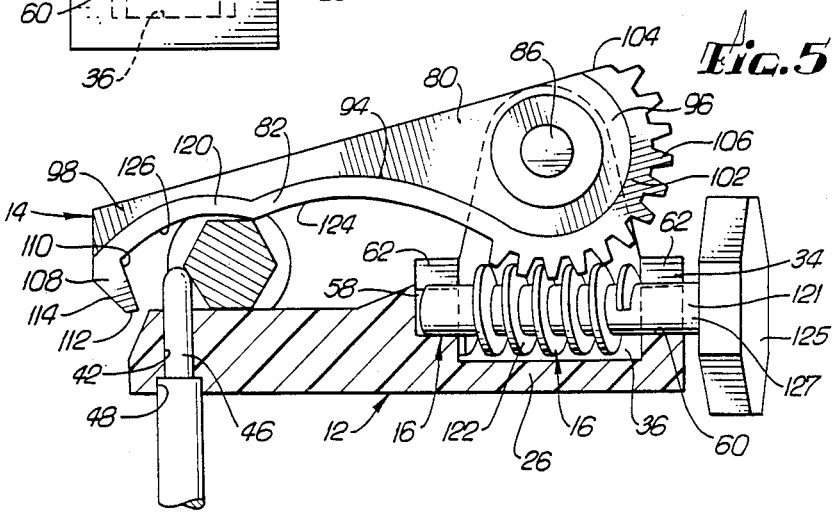
FIG. 5 is a fragmentary transverse sectional view of the present invention taken substantially along the lines 5—5 of FIG. 1.

Referring now to FIG. 5, the pivoting member 14 has a first or proximal end 96 and a second or distal end 98. Concentrically formed along the axis of the pivot pins 86 at the proximal end 96 hub portion 90 having a hub surface 100, and, along the engaging lip 82, is a tooth or gear portion 102. The gear portion 102 is formed to threadingly engage the worm member 16 and selectively effect the pivoting of the pivoting member 14 relative the reference member 12. In one embodiment the gear portion 102 extends from a second or upper edge 104 of the planar panel 80 or pivoting member 14, about 35 degrees above the horizontal axis running through the pivot pin 86, to extend along the peripheral engaging lip 82 for about 180 degrees. In one embodiment, about twelve straight cut teeth 106, having an outside radius from the central pivot pin axis of about 0.279 inches, are formed. The teeth 106 extend radially outward from the central axis of the pivot pin 86 a sufficient distance to engage the worm member 16 when the pivot pins 86 are inserted within the receiving apertures 68 in the mounting flanges 66.

Still referring to FIG. 5, a hooking tab 108 extends outward from the distal end 98 of the pivoting arm 14. In the preferred embodiment, the hooking tab 108 extends from the pivoting member 14 towards the reference member 12 about one-quarter of an inch from the upper edge 104 of the pivoting member. In addition, the tab 108 has a first or inward face 110, a second or tab face connecting surface 112, and a third or outward face 114. The outward face 114 is generally angled from the distal end 98 towards the proximal end 96 of the pivoting member 14 about thirty degrees off the vertical. The inward face 110 is generally angled inward from the distal end 98 towards the proximal end 96 of the pivoting member 14 about ten degrees off the vertical, so that the hooking tab 108 generally slants or extends inward from the distal end 98 towards the proximal end 96.

A contoured engaging surface 120 for engaging variously shaped test items is formed on the engaging lip 82 extending between the gear portion 102 and the hooking tab 108, adjacent said distal end 98. In the preferred embodiment, the contoured engaging surface 120 includes a first arc portion 124 having a first radii and a first center, which merges into a second arc portion 126, having a second center and a second radii. For purposes of clarity, the centers are defined in a plane generally parallel with the central panel 80 relative an origin (0,0) defined as the central axis of the pivot pins 86. The X-axis is defined generally parallel to the second edge 104 and the Y-axis generally orthogonal thereto. In the preferred embodiment, the first center is about 0.463 inches downward or in the negative Y direction relative the central axis of the pivot pins 86 (the origin) and outward about 0.566 inches in the negative X direction (generally towards the distal end 98). The first radii extends from such first center about 0.5 inches along the outer surface of the contoured engaging lip 82 and about 0.545 inches along an inward surface 94 of the lip to define those respective surfaces. In the preferred embodiment, the second center is located in the negative Y direction relative the pivot pin center (the origin) about 0.229 inches and displaced in the negative X direction (towards the distal end 98) about 0.827 inches therefrom. From such second center the top surface of the lip is a radii of about 0.300 inches and the inside lip surface is about a radius of about 0.345 inches.

As shown in FIG. 5, sized to be inserted within the receiving cavity 36 of the base 20 and resting within the receiving slots 58 and 60 in the end walls 32 and 34 is a worm member 16. The worm member 16 has a shaft 121 with a threaded portion 122 formed thereon. The threaded portion 122 is sized to be received within the receiving cavity 36. The shaft 121 is sized to be slidably or rotably placed within the slots 58 and 60 and allow the rotable mounting of the worm member 16 within the cavity 36. A head 125 is formed at a first end 127 of the worm member 16 to allow selective axial rotation of the worm member 16. The head 125 may be in the form of any polygon, for example, a decagon, to facilitate the gripping and application of torque to the worm member 16 and thus its selective axial rotation relative the reference member 12.

In operation, the worm member 16 is placed in the receiving cavity 36 of the reference member 12. After the pivot pins 86 of the pivoting member 14 are substantially aligned with the beveled insertion notches 88, the pins are urged towards and snappingly inserted within the receiving pin apertures 68. In this configuration, the gear portion 102 of the pivoting member 14 is interdigitated or meshed with the threaded portion 122 of the worm gear member 16. The head 125 of the worm member 16 is axially rotated in a first direction to move the distal end 98 of the pivoting member 14 from a first position adjacent the reference member 12 to a second position spaced apart therefrom. The terminal lead 46 is urged into and through the receiving bore 42 to extend through and beyond the reference member 12 a short distance. The terminal lead 46 is then juxtaposed against or positioned adjacent the desired item to be contacted. The head 125 is then counter-rotated in a second or opposite direction to axially rotate the worm member 16 and thus pivot the distal end 98 of the pivoting member 14 from a spaced apart position to another position adjacent or closer to the reference member 12. Continued rotation of the head 125 abuts the engaging surface 120 of the pivoting member 14 with the item to be contacted and the terminal lead 46 directly contacts the individual item.

Figure 6:
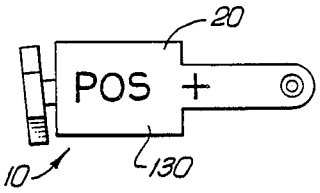
FIG. 6 is a bottom elevational view of the present invention.
Figure 7:
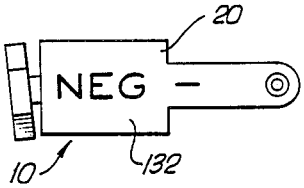
FIG. 7 is a bottom elevational view of another embodiment of the present invention.

Since the particular electrical connector 10 of the present invention need not conduct electricity, it may be formed wholly of a non-conductive material, for example, rexene 17S6A polypropylene. Since the entire connector may be formed of this non-conductive material, each individual clip may be molded from different colored material and can provide an easy indicator as to the polarity of the particular wire. As best shown in FIGS. 6 and 7, identifying indicia 130 and 132 may be formed within the base portion 20 to additionally label the respective positive or negative clips 10. Indeed, since the entire clip 10 is formed of a non-conductive material, inadvertent electrical shocks to the operator are reduced.

Figure 8:
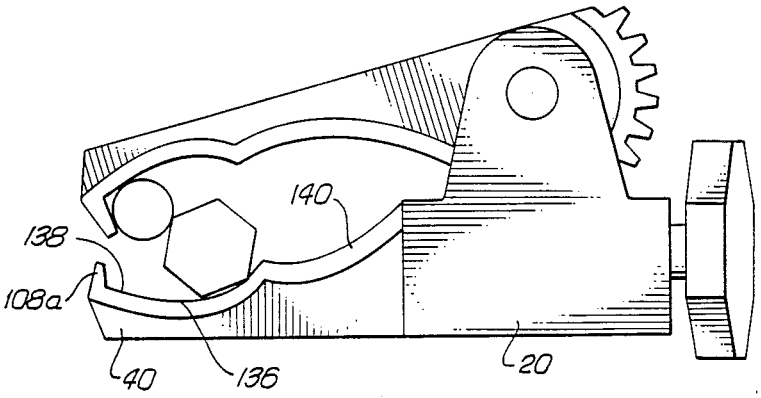
FIG. 8 is a side elevational view of another embodiment of the present invention in combination with electrical terminals.

Referring now to FIG. 8, there is shown another embodiment of the present invention. This embodiment includes the engaging arm 40 having a second contoured engaging surface 136. In the preferred embodiment, the second contoured engaging surface 136 has a third and forth arc portions 138 and 140, have third and fourth radii and centers. For example, the engaging arm 40 may be constructed by cutting a pivoting member 12 as described elsewhere in this application along a line substantially perpendicular to the upper edge 104 and joining that portion, including the second contoured engaging surface 136 and hooking tab **108*a*, to the base portion 20**.

It will be appreciated from the foregoing that the present invention represents a significant advance in the field of electrical connectors. In particular, the present invention provides a means to adapt to variously shaped terminals with a multi-contoured engaging surface and hooking tab. It will also be appreciated that, although the presently preferred embodiments of the invention have been described by way of example, various modifications may be made without departing from the spirit and scope of the invention. Accordingly, the present invention is not limited except as by the appended claims.

What is claimed is:

1. A clamping device for directly contacting a terminal lead with variously shaped test items, said clamping device comprising:

a reference member having a first end, a second end and means for receipt of said terminal lead;

a pivoting member having means for engaging variously shaped test items, a gear portion, a first end and a second end, said pivoting member being pivotally mounted at said first end to said reference member, said means for engaging variously shaped items formed adjacent said second end and said gear portion formed at said first end;

gear means threadingly engaged with said pivoting member for pivoting said second end of said pivoting member from a first position to a second position spaced apart from said reference member.

2. A clamping device as set forth in claim 1 above, wherein said clamping device further includes a hooking means formed upon said pivoting member for maintaining a grip on said test items.

3. A clamping device as set forth in claim 2, wherein said means for engaging variously shaped test items includes an engaging surface having a contoured surface.

4. A clamping device comprising:

a reference member having a longitudinal axis, a first end, a second end, and a pair of mounting flanges, said reference member defining a cavity formed within said first end and having a first arm extending outward at said second end, said pair of mounting flanges extending outward from said reference member first end, each said flange having a pivot pin aperture formed therein, said apertures aligned with each other;

a worm member rotatably mounted within said cavity; and a pivoting member, having a first end, a second end, an engaging surface, a gear portion, a hooking tab, and a pair of pivot pins, said gear portion formed at said first end and in interdigitated, meshed engagement with said worm member, said engaging surface formed adjacent said second end, said hooking tab extending outward from said second end generally towards said reference member, said pair of pivot pins extending laterally outward from said pivoting member at said first end for rotatable receipt within said pivot pin apertures within said mounting flanges.

5. A clamping device as set forth in claim 4, wherein said first arm includes a second hooking tab extending outward from said second end towards said pivoting arm, and a contoured portion extending between said first end and aid second end.

6. A clamping device as set forth in claim 4 wherein said pivoting member has a receiving bore formed therethrough.

7. A clamping device as set forth in claim 6, wherein said receiving cavity is formed generally parallel to said longitudinal axis.

8. A clamping device as set forth in claim 7, wherein said hooking tabs are angled from said second end towards said first end.

9. A clamping device as set forth in claim 7, wherein said gear portion of said pivoting member includes straight cut teeth and said receiving cavity is angled a sufficient amount off said longitudinal axis to engage said straight cut teeth.

10. A clamping device for use in combination with a first and a second terminal leads, said clamping device comprising:

a reference member having a first end, a second end, a longitudinal axis extending between said ends, said reference member defining an aperture and a cavity therein, said aperture formed in said second end and sized to snuggly receive said first terminal lead, and said cavity formed within said first end and generally parallel with said longitudinal axis;

a pair of first and second generally parallel flanges extending outward from said reference member, each said flange having a pivot aperture formed therein said pivot apertures substantially aligned with each other;

a worm gear member rotatably mounted within said cavity and generally parallel with said longitudinal axis;

a pivoting member having a first end, a second end, an engaging surface, and a geared portion, said engaging surface formed substantially at said second end and including a surface contour having at least a first and a second arc portions, said gear portion formed substantially at said first end;

a hooking tab extending outward from said pivoting member from said second end toward such first end; and a pair of pivot pins extending outward from said pivoting member, said pins positioned and sized for pivotal receipt within said pivot apertures and to position said gear portion into interdigitated meshed engagement with said worm gear member such that axial rotation of said worm gear meshed with said geared portion moves said second end of said pivoting member from a first position to a second position spaced apart from said reference member.

* * * * *

UNITED STATES PATENT AND TRADEMARK OFFICE

CERTIFICATE OF CORRECTION

PATENT NO. : 4,986,771

DATED : Jan. 22, 1991

INVENTOR(S) : Richard R. Braswell

It is certified that error appears in the above-identified patent and that said Letters Patent is hereby corrected as shown below:

On the title page:

Item [21], delete "121,279" and insert therefore --421,279--.

ABSTRACT, line 4, insert before "a receiving" the word --defining--.

Signed and Sealed this

Twenty-eighth Day of July, 1992

*Attest:*

DOUGLAS B. COMER

*Attesting Officer*

*Acting Commissioner of Patents and Trademarks*